US005577459A

United States Patent [19]

Alden

[11] Patent Number: 5,577,459

[45] Date of Patent: Nov. 26, 1996

[54] PAGE AND PARAGRAPH INDICATING BOOKMARK

[76] Inventor: William Alden, 10698 Maplewood Rd., Unit C, Cupertino, Calif. 95014

[21] Appl. No.: 427,120

[22] Filed: Apr. 24, 1995

[51] Int. Cl.[6] ..... B42D 9/00

[52] U.S. Cl. ..... 116/234; 116/235; 281/42

[58] Field of Search ..... 116/234–240, 321–324; 281/42

[56] References Cited

U.S. PATENT DOCUMENTS

| | | | |
|---|---|---|---|
| 168,395 | 10/1875 | Harris | 116/234 |
| 1,232,116 | 7/1917 | Stechan | 116/236 |
| 1,966,340 | 7/1934 | Forbringer et al. | 116/235 |
| 2,248,161 | 7/1941 | Cross | 116/324 |
| 3,266,456 | 8/1966 | O'Reilly | 116/235 |
| 4,009,679 | 3/1977 | Kircher | 116/321 |
| 4,901,665 | 2/1990 | Carlin | 116/240 |
| 5,081,948 | 1/1992 | Walsh | 116/235 |
| 5,305,706 | 4/1994 | Arjomand | 116/234 |
| 5,311,835 | 5/1994 | Knowles | 116/234 |

FOREIGN PATENT DOCUMENTS

| | | | |
|---|---|---|---|
| 2222387 | 3/1990 | United Kingdom | 116/234 |

*Primary Examiner*—William A. Cuchlinski, Jr.
*Assistant Examiner*—Andrew Hirshfeld

[57] ABSTRACT

A book mark that indicates the page and last paragraph read on an open page of text that contains a specified number of paragraphs or less. The bookmark utilizes an imprinted encircling indicator band or collar that slides vertically about the body of an imprinted thin paper board or plastic strip. The collar is characterized by a centrally located punched-out aperture that serves as a framing device to highlight the indicia imprinted on the body of the bookmark specifying the page and number of the last paragraph read. The body is imprinted with two sets of indicia to permit selection of even or odd numbered pages.

1 Claim, 1 Drawing Sheet

PAGE AND PARAGRAPH INDICATING BOOKMARK

FIELD OF THE INVENTION

The present invention is an advancement in the field of bookmarks with particular reference to those bookmarks that are capable of identifying both the last page as well as a particular portion of text on the last page read.

PRIOR ART

A number of bookmarks have attempted to incorporate line locating devices as in U.S. Pat. No. 3,266,456 which makes use of a rotatably and slidably mounted locating arrow. Another example is to be found in U.S. Pat. No. 1,232,116 where a sliding arrow moves along a central axis internal to the bookmark. A variation on this latter bookmark is described in U.S. Pat. No. 5,081,948 which uses opposing first and second faces to assure an accurate reading no matter how the book is opened. Each of the foregoing has as its object the location of a specific line by means of a movable indicating device to physically locate the desired specific line. Due to the requirement that a specific line is referenced by the pointer, all of the foregoing indicating bookmarks are subject to misalignment due to jarring or other disturbance.

There therefore now exists a need for an improved bookmark which is not subject to misalignment due to problems attendant to the handling of the book in which it is placed. This improved bookmark points to an abstract concept, the paragraph, rather than a particular physical embodiment. The implementation by use of a sliding aperture mechanism yields a device that is highly resistant to the environmental influences that would prompt other devices to give false indications of the text selected.

SUMMARY OF THE INVENTION

The present invention relates to specialized bookmarks that are capable of identifying not only the last page read, but also providing indicators that direct the user to a particular point in the text. This improved bookmark reliably indicates a previously selected paragraph. The number of paragraphs that can be accommodated are limited only by the number of graduations marked on the body of the bookmark.

Bookmarks are common and a number have incorporated indexing devices to direct readers to specific lines. But due to the variations in the size of books, combined with variations in the numbers of lines of print, such devices are limited by either the dimensions of the bookmark or subject to inaccuracies arising from displacement of the bookmark through jarring contact.

The principal object of the present invention is to provide a reliable reference to paragraphs, which are invariably fewer in number than the number of lines that are contained by the paragraphs. Accordingly the invention is suitable for use with nonstandard textual material that incorporates a larger number of paragraphs than would normally be found.

The second object of the invention is the provision of a bookmarking device that is not dependent upon any particular set of page dimensions. The invention works equally well with very long or very short pages without a necessity for increasing or decreasing the size of the bookmark to accommodate a particular page size.

A third objective is the protection provided against displacement of the indicator as a consequence of jarring. By virtue of the frictional tension between the collar and the body of the bookmark, a high degree of reliability is achieved in retaining the setting that indicates the desired portion of the text.

The foregoing objectives are accomplished in the manner illustrated in the accompanying drawings, in which like reference numerals indicate like parts and in which:

DESCRIPTION OF THE PREFERRED EMBODIMENT

Figures 1, 2:
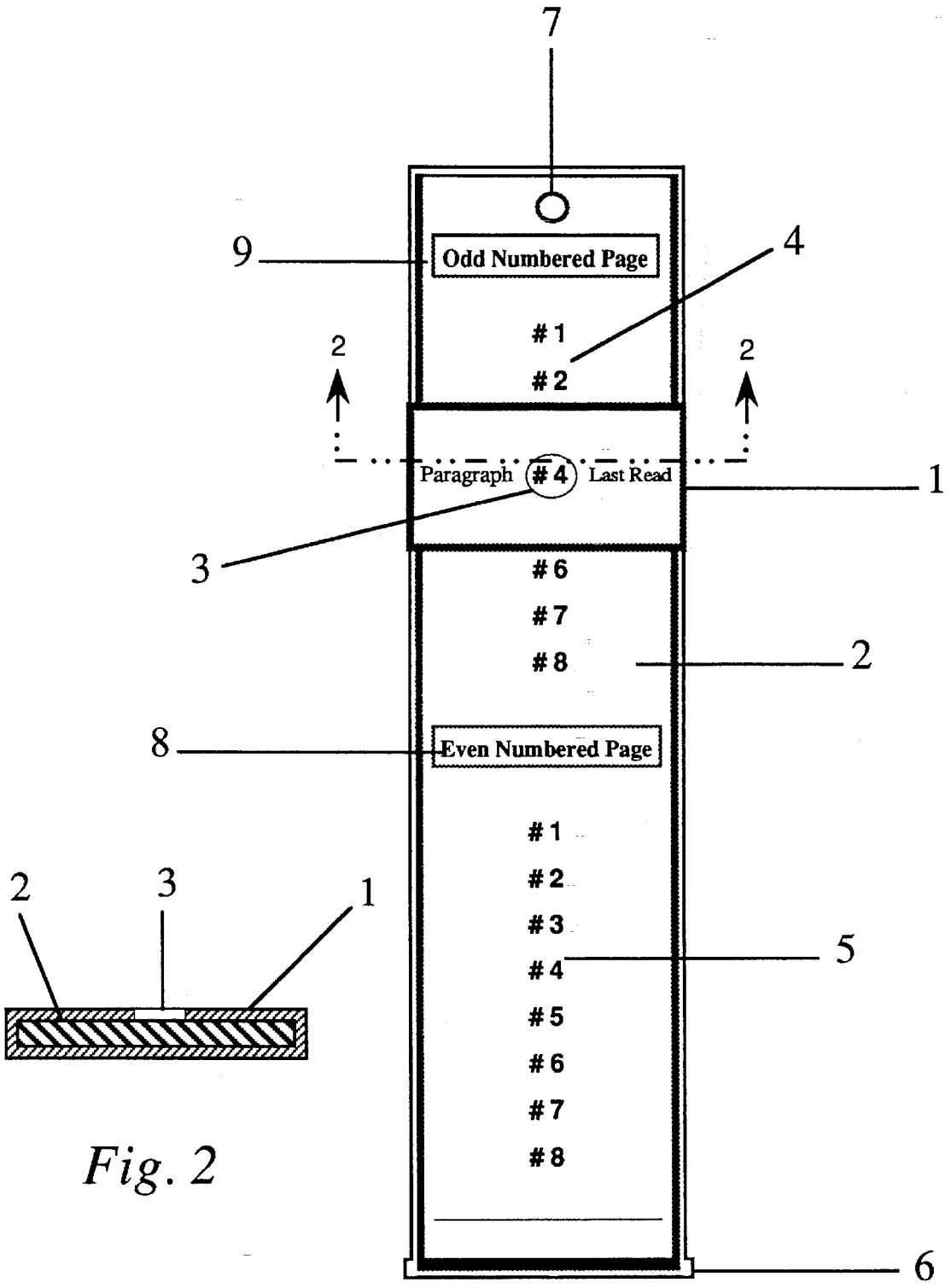
FIG. 1 is a small scale plan view of the front of the device illustrating the adjustable collar in position on the body of the bookmark.
FIG. 2 is a sectional view of the bookmark taken along line 2—2 of FIG. 1.

The device in its preferred embodiment is a bookmark with a sliding collar capable of simultaneously identifying a page and paragraph of text. Operation is effected as is illustrated in FIG. 1 by sliding the friction collar 1 up or down the body 2 of the bookmark until the aperture 3 on the collar permits the imprinted numeric indicia 4 or 5 of the selected paragraph to be viewed through the aperture. The friction collar is prevented from sliding off the body by the pedestal base 6 that is formed at the bottom of the body and the grommet retaining ring 7 that serves as a combination keeper and mounting device for display racks.

The bookmark has two alphabetic headers 8 and 9 imprinted on the body of the bookmark to indicate that the first and second sets of numerals 4 and 5 below the headers correspond to paragraphs upon an odd and even page. Although illustrations 4 and 5 embody a series of indicia from #1 to #8; one set to indicate odd pages and one set to indicate even pages, any other sets of indicia could be devised by one skilled in the art and that such other arrangements may be employed without departing from the spirit and the scope of the invention as set forth in the appended claims.

I claim:

1. A bookmark for use with a book, said bookmark comprising:

a thin, flat rectangular body;

a first heading means disposed upon said body for indicating one page selected from the group consisting of an odd page of the book and an even page of the book, said first heading means being alphabetic indicia;

a first set of numeric indicia disposed upon said body, said first set of numeric indicia being sequential numerals beginning with the number one and incrementing in an ascending order toward a bottom of said body, said first set of numeric indicia being located below said first heading means, said first set of numeric indicia representing paragraphs on the one page;

a second heading means for indicating the other page selected from the group consisting of an odd page of the book and an even page of the book, said second heading means being alphabetic indicia disposed upon said body at a location below said first set of numeric indicia;

a second set of numeric indicia disposed upon said body, said second set of numeric indicia being sequential numerals beginning with the number one and incrementing in an ascending order toward said bottom of said body, said second set of numeric indicia positioned below said second heading means, said second set of numeric indicia representing paragraphs on the other page; and a collar having an aperture therethrough, said collar being frictionally secured to said body, said collar also being slidable along the length of said body to display, through said aperture, each of said numerals of said first and second sets of numeric indicia, said aperture being configured such that not more than one numeral of said first and second sets of numeric indicia is entirely viewable through said aperture at any position of said collar along the length of said body.

* * * * *